US005845181A

United States Patent [19]

Bartscher

[11] Patent Number: 5,845,181

[45] Date of Patent: Dec. 1, 1998

[54] TONER-BASED PRINTING DEVICE WITH CONTROLLED DELIVERY OF TONER PARTICLES

[75] Inventor: Gerhard Bartscher, Heidelberg, Germany

[73] Assignee: Heidelberger Druckmaschinen Aktiengesellschaft, Germany

[21] Appl. No.: 923,658

[22] Filed: Sep. 4, 1997

[30] Foreign Application Priority Data

Sep. 16, 1996 [DE] Germany ..... 196 37 613.0

[51] Int. Cl.[6] ..... G03G 15/08

[52] U.S. Cl. ..... 399/253; 399/265

[58] Field of Search ..... 399/53, 98, 222, 399/236, 252, 253, 272, 281, 265, 149, 150; 430/120

[56] References Cited

U.S. PATENT DOCUMENTS

| | | | |
|---|---|---|---|
| 4,545,325 | 10/1985 | Komatsu et al. | 399/253 X |
| 5,027,157 | 6/1991 | Hotomi et al. | 399/253 |
| 5,231,458 | 7/1993 | Nishimura | 399/253 |
| 5,391,455 | 2/1995 | Bigelow | 430/120 |

FOREIGN PATENT DOCUMENTS

| | | |
|---|---|---|
| 3-203758 | 9/1991 | Japan . |
| 5-249831 | 9/1993 | Japan . |
| 7-306584 | 11/1995 | Japan . |
| 9-114217 | 5/1997 | Japan . |

OTHER PUBLICATIONS

Thompson, J. A., "A Review of the Development Process Technology Utilized in the IBM LaserPrinter Family," pp. 72–84.

Schein, L.B., "Elektrophotographic [electrophotography] and Development Physics" –Springer Publishing House 1992. Chapter 2, pp. 26–49; pp. 89, 90, 109, 119, 163, 239, 258, 306; Chapter 4 pp. 63–93; pp. 87–92 (4.4.4) and Chapter 8 pp. 187–202.

Roller Construktion, IBM Technical Disclosure Bulletin, vol. 33, No. 5, Oct. 1990, pp. 27–29.

*Primary Examiner*—Arthur T. Grimley
*Assistant Examiner*—Sophia S. Chen
*Attorney, Agent, or Firm*—Kenyon & Kenyon

[57] ABSTRACT

A printing machine for creating an image through the use of toner particles. the printing machine having a development device for preparing the toner, and the development device having at least one filter for selecting toner particles.

8 Claims, 2 Drawing Sheets

TONER-BASED PRINTING DEVICE WITH CONTROLLED DELIVERY OF TONER PARTICLES

FIELD OF THE INVENTION

The present invention relates to the field of toner-based printing processes, and especially printing processes using electrostatic development units which preferably use dry toner to make visible a latent electrostatic charge pattern.

RELATED TECHNOLOGY

A variety of electrostatic development units are known from photocopiers (black/white and color) and from laser printers.

To clarify the invention, the functioning method of a laser printer is described as follows. With the aid of a corona unit, a surface charge is applied to a drum having a photoconductor. The photoconductor has the characteristic that it becomes electrically conductive when irradiated. Thus, by irradiating with a modulated laser beam, the charge is produced at the desired locations. Thereupon, the thus produced electric charge pattern is made visible with the aid of a development station. Basically, in such a station, a multitude of electrostatically charged ink particles, called toner particles, which typically have a diameter of 10 $\mu$m, are offered to the surface having the charge pattern. Usually the toner particles have a polarity opposite to that of the surface charge on the photoconductor, so that the toner particles are attracted and adhere to the charged areas, while they do not adhere to the uncharged areas, these areas remaining white. The thus developed toner image is subsequently transferred with electrostatic assistance onto paper. The photoconductor is then cleaned and discharged, so that the printing operation can start again from the beginning.

A fundamental problem in the case of the development stations described is the defined electrostatic charging of the toner particles, the emphasis being on the word "defined". Charges are typically in the range of 10 to 20 $\mu$C/g, this value representing only an average value. There is a distribution of this charge, i.e., a large portion of the toner particles has a perceptibly higher or lower charge than the average value. It is an aim of the present invention to keep this distribution as narrow as possible, in order to have conditions which are as defined as possible. A disadvantage if the charge distribution is too wide is that image development cannot be controlled very exactly. It can happen in this context that in one portion of the toner particles which is actually positively charged, an unwanted negative charge develops; this is known as "Wrong Sign Toner". These are toner particles whose electrical charge is of reverse polarity compared to the majority of particles. Because of the broad charge distribution described, such an unwanted "Wrong Sign Toner" is always present in the case of the embodiments according to the related art.

In principle, the toner particles are charged with the aid of triboelectric effects. In this context, the toner particles become electrostatically charged by rubbing against another material. This typically is achieved concretely by the selection of suitable combinations of materials, as well as by using special charge generators. Both the technical literature and the patent literature offer a multitude of variations of this fundamental principle, which comes to light from the publication by L. B. Schein—"Elektrophotographie [electrophotography] and Development Physics"—Springer Publishing House 1992, as well as from the publication of J. A. Thompson—"A Review of the Development Process Technology Utilized in the IBM Laser Printer Family"—6th International Congress on Advances in Non-Impact Printing Technologies 1992, pages 72–84.

SUMMARY OF THE INVENTION

An object of the present invention is to keep the charge distribution as narrow as possible, and to offer only a predetermined charge to the surface to be developed. An additional object of the present invention is to eliminate the unwanted, so-called "Wrong Sign Toner".

The present invention therefore provides a printing machine for creating an image by means of toner particles, the printing machine having a development device for preparing the toner, characterized in that the development device has at least one filter for selecting toner particles.

An improvement due to the embodiment according to the present invention can be seen in that only predetermined charges reach the surface to be developed, and that the so-called "Wrong Sign Toner" can be eliminated.

Further advantageous refinements of the present invention include that the selection is carried out on the basis of the charge adhering to the toner particle or that the selection is carried out on the basis of the size or the mass of the toner particle. Another advantageous refinement is that a carrier is provided which receives toner particles of the most variable charge, and that a separating device is provided which acts on the carrier in a manner that the toner particles having a desired, predetermined charge are removed from the carrier. In addition, a carrier may be provided which receives toner particles of variable charge, and that a separating device is provided which acts on the toner particles in a manner that only the toner particle having a predetermined, selected charge is loosened from the carrier and transferred onto an image-carrier surface to be developed for the image. The carrier which transports the differently charged toner particles may be a belt. The carriers of the toner particles also may be rolls. The belt may be a continuous belt which is transported via guide rolls, at least one roll having a very small diameter.

Another advantageous refinement includes that a reservoir (13) for toner particles is provided in which uncharged toner particles (10) are contained, that a roll (1) is provided which receives the uncharged toner particles on its surface, that a roll (2) is provided which receives the uncharged toner particles from roll (1), that a doctor blade (6) is provided which acts on the surface of roll (2) and provides the toner particles located on the surface of roll (2) with a charge, that a roll (3) is provided which acts on the surface of roll (2), and that said roll (3) pulls strongly charged toner particles located on the surface of roll (2) off of said roll (2), that a roll (4) is provided which interacts with roll (2) in a manner that toner particles located on the surface of roll (2), provided that they have a predetermined charge, are received by roll (4), and that the selected toner particles located on the surface of roll (4) are transferred onto the image-carrier surface to be developed for the image.

Moreover, a doctor blade (6) may be provided which interacts with belt (2), carrying the toner particles, in such a way that the clearance between the surface of belt (2) and doctor blade (6) is adjustable and, because of this, toner particles which are larger than the adjusted clearance are wiped off from belt (2) by doctor blade (6).

Another advantageous development includes that a roll (17) is provided for guiding and deflecting belt (2), said roll (17) being so dimensioned that deflecting belt (2) forms a small radius of curvature in the area of roll (17). The velocity of belt (2) may be variable, and, according to the adjusted velocity of belt (2), toner particles having less holding force in relation to the centrifugal force acting on the toner particles in the area of roll (17) are hurled by the centrifugal force from belt (2). Belt (2) can be provided with different dielectric constants, and the holding force of the toner particles is adjustable proportional to the dielectric constants. Belts (2) may be used having different thickness, and the holding force of the toner particles is adjustable based on the selection of the belt thickness.

The present invention offers the possibility of separating the toner particles according to their charge. However, it is also possible to separate the toner particles according to their size or mass. In carrying out the selection according to size or mass, centrifugal forces are utilized which act on the particles. Furthermore, by means of the refinement of a small radius of curvature, influence is exerted on the centrifugal forces or the holding forces of the particles.

This separation of the toner particles on the basis of size and mass is carried out preferably in an arrangement in which a conveyor belt is used, with which particles are transported. At least one guide roll over which the conveyor belt runs can have a very small radius of curvature. In one particular specific embodiment, the variation of the conveyor-belt velocity results in an appropriate selection of the particles, as quell. In another special specific embodiment, the toner particles are transferred from one roll to other rolls. The selection is carried out there on the basis of the desired charges. Unwanted charges are kept from further transport on another roll.

In a further advantageous specific embodiment, a doctor blade is disposed with clearance from the conveyor-belt surface. By varying the clearance, it is possible to wipe particles off the belt which are larger than the adjusted clearance. The possibility of working with different dielectric constants has an advantageous effect on the adjustment of the desired holding force of the toner particles. In addition, it is possible to use different thicknesses for the conveyor belt, which can also have an advantageous effect on the holding force, or the adjustment of the highest holding force.

BRIEF DESCRIPTION OF THE DRAWINGS

In the following, two exemplary embodiments are described which clarify the subject matter of he invention. Of these.

DETAILED DESCRIPTION

Figure 1:
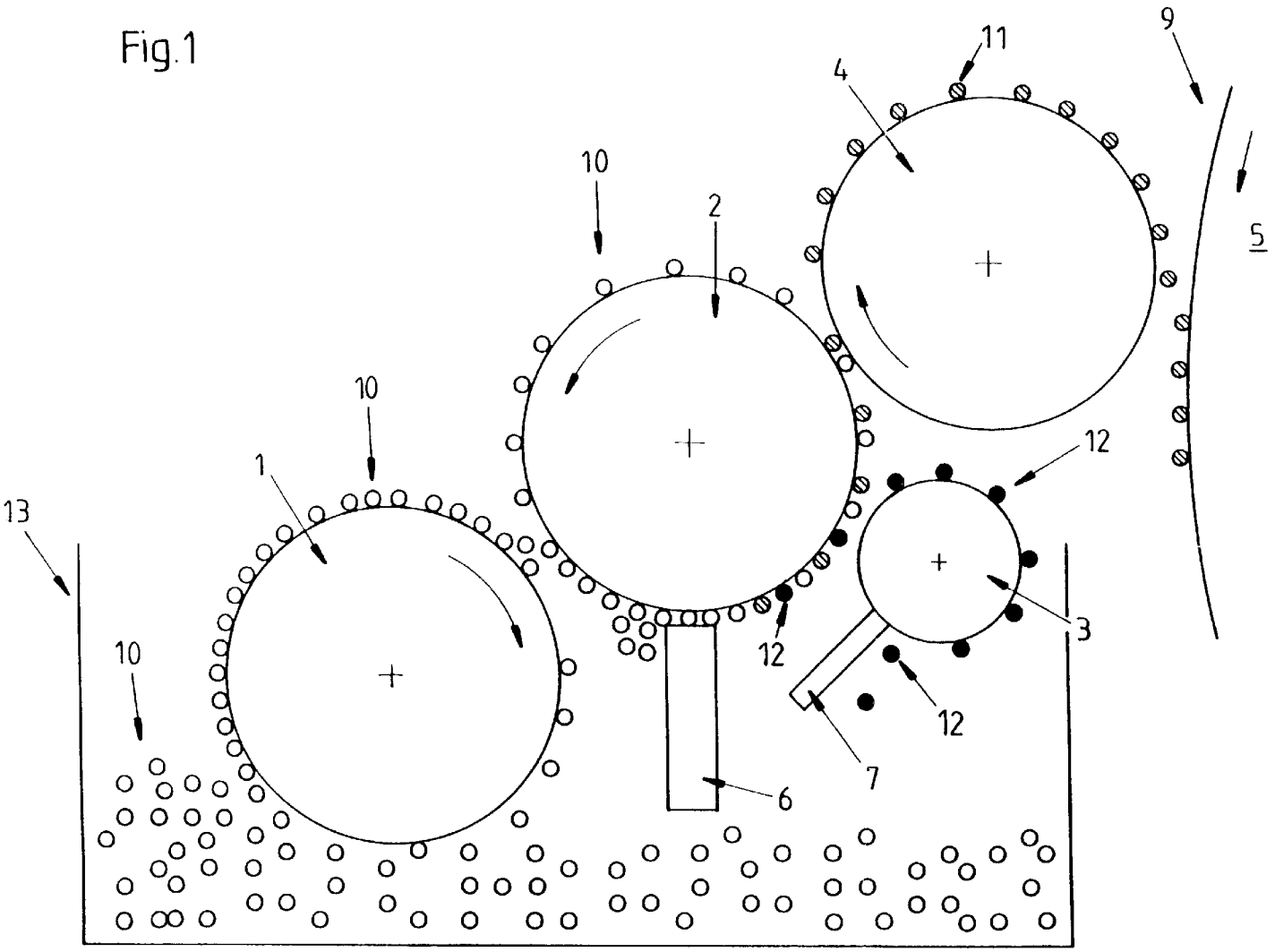
FIG. 1 shows a first embodiment of the printing device of the present invention.

FIG. 1 shows a first exemplary embodiment in which each of the four pictured rolls (1,2,3,4) can be brought to a defined electric potential (not shown here) independently of the other rolls (1,2,3,4). More or less thin coatings can be provided on the roll surfaces to support various functions. Uncharged toner particles 10 are transported with the help of a roll 1 from a reservoir 13 to a second roll 2, are pressed against said roll 2 and, due to the friction developing in so doing, already become weakly charged. In this context, the materials of toner 10,11,12 and of the (typically rubber-like) coating are so selected that a charge is generated which is as defined as possible. Roll 2 works together with a doctor blade 6 in a manner that doctor blade 6 presses toner particles 10 again and more intensely against the surface of roll 2. Due to this pressing action, the charge of toner particles 10 is intensified. In addition, this operation can be supported by applying a voltage (not show here) between roll 2 and doctor blade 6 (which is preferably metallic). Another task of doctor blade 6 is to regulate the diameters of the toner particles present on roll 2. For example, the diameter of the toner particles to be developed can be upwardly limited by the appropriate placement of doctor blade 6 with respect to roll 2.

A potential is applied to roll 2 in such a way that an electric field arises between rolls 2 and 3. The field strength is so selected that strongly charged particles 12, which can be seen as darkly depicted particles in FIG. 1, are drawn from roll 2 onto roll 3. Here, advantage is taken of the effect that the force on the particle is directly proportional to the charge on a toner particle. Thus, an upper limit can be set in a defined manner for the charge of the particles which are later offered to the surface to be developed.

Simple charging of development rolls is known for example from U.S. Pat. No. 5.475,447, which is hereby incorporated by reference herein.

In the next step, toner particles 10 whose charge is too low are separated out. This is accomplished by applying an electric voltage between roll 2 and roll 4, as well. The voltage is so selected that toner particles 10 having a lower charge are not transferred onto roll 4. The fundamental principle of charge generation by triboelectric interactions described above is advantageous with regard to the charging of toner particles in the case of rolls 1 and 2, however the triboelectricity can have a disturbing effect with regard to the transfer from roll 2 onto roll 4. Particles having a defined charge when leaving roll 2 interact when meeting with the surface of roll 4, in the course of which charges can be exchanged. This effect can again destroy a part of the previous selection activity. To keep the influence of the change in charge due to triboelectricity as small as possible, in advantageous manner, a material is used for the surface of roll 4 which produces triboelectric interactions with the toner particles to only a small degree. Preferably, two classes of materials are possible for this. These are materials which are very similar or identical in composition to the toner particles and materials which are closely adjacent in the triboelectric series (see. for example, L. B. Schein. cited above and herewith incorporated by reference herein). In using such materials, the change in charge of the toner particles due to the contact with the surface of roll 4 is minimized in an advantageous manner.

This advantageous measure makes it possible to set an upper and a lower limit for the particle charge. Thus according to the present invention, only particles 11 having a charge within the desired range are on roll 4. These toner particles 11 are then offered to the surface to be developed (for example, a photoconductor), where the developing process can proceed in the form indicated. Because a defined charge range is made available, the development process proceeds in substantially improved form.

The "Wrong Sign Toner", which is numbered among the greatest problems in such development units, is filtered out in advantageous manner by the present invention. The filtering is done in the above described form in such a way that particles having the wrong polarity are not offered to the surface to be developed.

Figure 2:
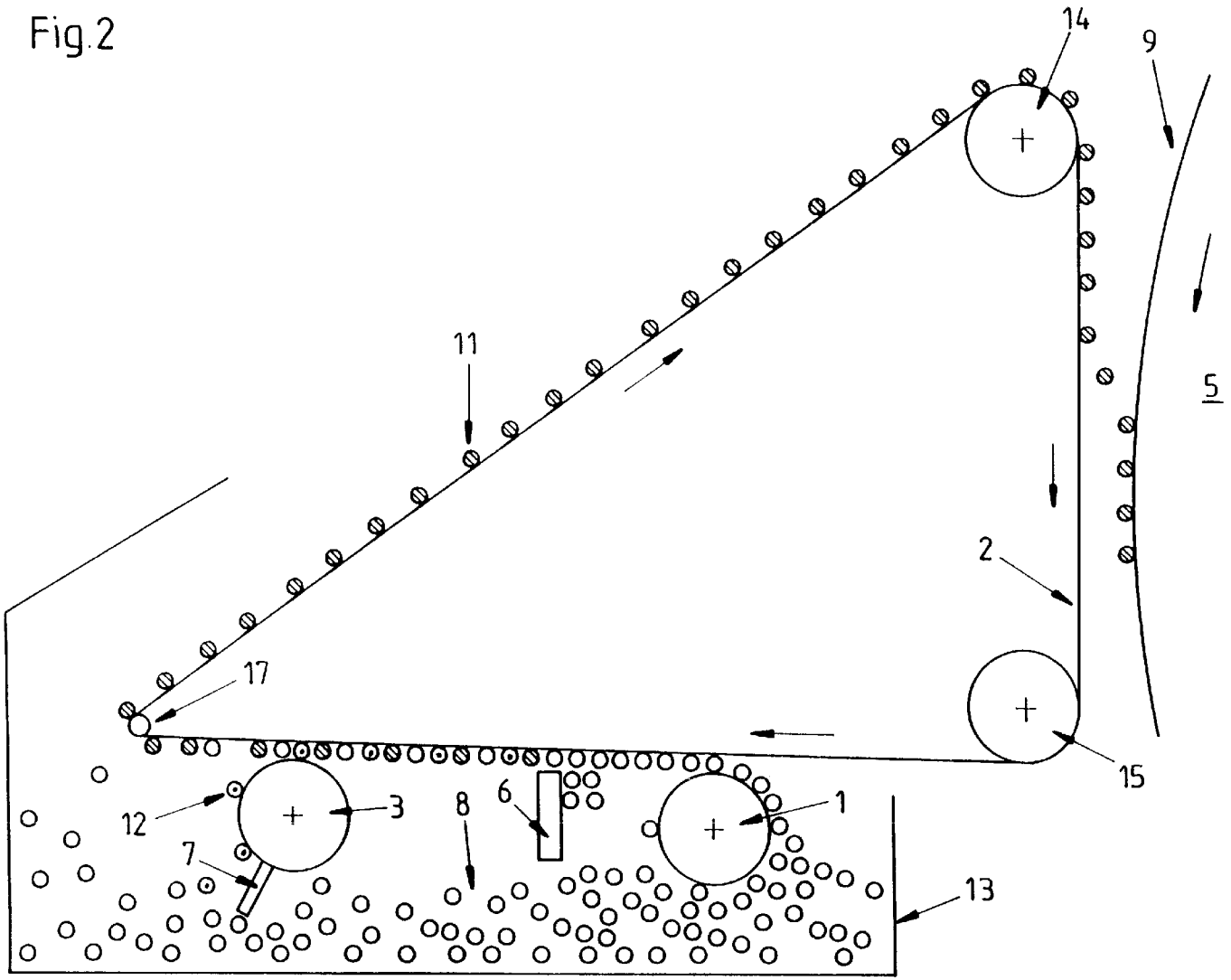
FIG. 2 shows a second embodiment of the printing device of the present invention.

Another exemplary embodiment is described with the aid of FIG. 2. Besides the advantage, already described in connection with FIG. 1, of avoiding the changes in charge of the toner particles already selected based on charge, the specific embodiment according to FIG. 2 offers the possibility of selecting the toner particles not only according to charge, but also according to size or mass. Here, the particles that are too weakly charged are sorted out by roll 17 which has a very small diameter. Due to the small radius of curvature, given appropriate belt velocity, centrifugal forces develop that hurl the weakly charged particles—which adhere only weakly to a belt 102—from said belt 102. The back side of belt 102 has a metallic character. Because of this, the back side of the belt is conductive, and thus produces an attractive force on a charged particle, the force being proportional to the square of the particle. The weakly charged particles are hurled from belt 102 by the centrifugal force, and thus separated. After that, only particles having the desired charge are on the belt. A selection of the particles which should still remain on belt 102 can be adjusted by selecting an appropriate dielectric constant of the belt coating, or by selecting an appropriate belt thickness. The belt velocity and the radius of roll 17 likewise have an effect on the separation process. Incidentally, the functioning method according to FIG. 2 is as follows: Uncharged toner particles 8 are located in a toner reservoir 13. The uncharged toner particles are fed to belt 102 via roll 1. A doctor blade 6 works together with belt 102 in a manner that the toner particles located on belt 102 can be wiped off from belt 102 by doctor blade 6 in desired quantity and based on a certain diameter. Moreover, doctor blade 6 assists in charge generation. The toner particles passing doctor blade 6 are transported from the belt to roll 3. Roll 3 removes from the belt the particles 12 which are too strongly charged. The toner particles which are too strongly charged now adhering to the surface of roll 3 are removed by way of a doctor blade 7 interacting with the surface of roll 3. Thereupon, just the particles which are not too strongly charged, as well as the too weakly charged particles are further transported on the belt. The particles that are too weakly charged are sorted out at roll 17, as already described above. The particles with too weak a charge fall back into reservoir 13 for toner particles. Only particles 11 which have survived the separation process intact are conveyed on conveyor belt 102, via a guide roll 14, to the surface 9, which is to be developed, of photoconductor 5. In so doing, belt 102 runs closely past the surface of photoconductor 5. As a result, the charged particles are transferred from the surface of belt 102 onto the surface 9, to be developed, of photoconductor 5. The belt is conducted once more via guide roll 15 to roll 1, and there the charge acceptance by the uncharged toner particles takes place anew.

The term "filter" as used herein means that during development toner particles are selected for a specific range. If toner particles are filtered out on the basis of charge then toner particles having charges too high and too low are discarded; if on the basis of mass then toner particles having a mass too high and too low are discarded. In the embodiment of FIG. 1, the filter thus comprises the rolls 2, 3 and 4, as voltage differences between rolls 2 and 3 eliminate too strongly charged particles, and voltage differences between rolls 2 and 4 filter out too weakly charged particles. In the embodiment of FIG. 2. the filter comprises the belt 102 and roll 3 to filter out particles too strongly and too weakly charged (or weighted) as described.

What is claimed is:

1. A printing device for creating an image through toner particles, the printing device comprising:

a development device for preparing the toner particles, the development device comprising a filter for selecting the particles to be delivered to an image carrier surface; the filter including a belt having different dielectric constants, and that a holding force of the toner particles is adjustable proportional to the dielectric constants.

2. A printing device for creating an image through toner particles, the printing device comprising:

a development device for preparing the toner particles, the development device comprising a filter for selecting the toner particles to be delivered to an image carrier surface: the filter including a belt, the belt having a belt thickness so that a holding force of the toner particles is adjustable based on a selection of the belt thickness.

3. A printing device for creating an image through toner particles, the printing device comprising:

a development device for preparing the toner particles, the development device comprising a filter for selecting the toner particles to be delivered to an image carrier surface: the filter including a belt for carrying the toner particles and a doctor blade which interacts with the belt so that a clearance between the belt and the doctor blade is adjustable and that toner particles which are larger than the clearance are wiped off from the belt by the doctor blade.

4. A printing device for creating an image through toner particles, the printing device comprising:

a development device for preparing the toner particles, the development device comprising a filter for selecting the toner particles to be delivered to an image carrier surface; the filter including a belt and at least one guide roll for guiding the belt, one of the at least one guide roll being so dimensioned that the belt forms a small radius of curvature.

5. A printing device for creating an image through toner particles, the printing device comprising:

a development device for preparing the toner particles, the development device comprising a filter for selecting the toner particles to be delivered to an image carrier surface; the filter including a moving belt having at least one guide roll and wherein a velocity of the moving belt is adjustable so that according to the velocity a portion of the toner particles in the area of the at least one guide roll are removed by the centrifugal force from the moving belt.

6. A printing device for creating an image through toner particles, the printing device comprising:

a development device for preparing the toner particles, the development device comprising a filter for selecting the toner particles to be delivered to an image carrier surface;

the filter including a carrier which receives variably-charged toner particles and a separating device which acts on the character so that toner particles having a desired predetermined charge are removed from the carrier;

the carrier which transports the variably-charged toner particles being a belt:

wherein the belt is a continuous belt which is transported via guide rolls, at least one guide roll having a very small diameter.

7. The printing device as recited in claim 6 further comprising the image carrier surface, the toner particles being loosened from the carrier being transferred to the image carrier surface.

8. A printing device for creating an image through toner particles, the printing device comprising:

a development device for preparing the toner particles, the development device comprising a filter for selecting the toner particles to be delivered to an image carrier surface;

a reserve for toner particles containing uncharged toner particles;

a first roll having a first surface which recieves the uncharged toner particles; and wherein the filter includes:

a first filter roll which recieves the uncharged toner particles from the first roll:

a doctor blade which acts on a surface of the first filter roll and provides the toner particles located on the surface of the first filter roll with a charge, a second filter roll which interacts with the surface of the first filter roll to pull strongly charged toner particles located on the surface of first filter roll off the first filter roll, and a third filter roll which interacts with the first filter roll so that toner particles located on the surface of the first filter roll having a minimum predetermined charge are recieved by the third filter roll and are transfered onto the image-carrier surface to be developed.

* * * * *